US009468822B2

(12) United States Patent
Mashburn et al.

(10) Patent No.: US 9,468,822 B2
(45) Date of Patent: Oct. 18, 2016

(54) METHODS FOR A VERTICALLY CARRIED GOLF BAG

(71) Applicants: Kirk Mashburn, Bellflower, CA (US); Glenn Mashburn, San Clemente, CA (US)

(72) Inventors: Kirk Mashburn, Bellflower, CA (US); Glenn Mashburn, San Clemente, CA (US)

( * ) Notice: Subject to any disclaimer, the term of this patent is extended or adjusted under 35 U.S.C. 154(b) by 0 days.

(21) Appl. No.: 15/164,015

(22) Filed: May 25, 2016

(65) Prior Publication Data

US 2016/0263452 A1 Sep. 15, 2016

Related U.S. Application Data

(62) Division of application No. 14/335,459, filed on Jul. 18, 2014, now abandoned.

(51) Int. Cl.
*A63B 55/00* (2015.01)

(52) U.S. Cl.
CPC ..... *A63B 55/408* (2015.10)

(58) Field of Classification Search
CPC ..... A63B 55/00; A45F 3/04; A45F 3/14; A45F 2003/045; A45F 3/02; B62B 2202/404; A45C 13/26; A45C 2003/007
USPC ..... 224/575, 153, 578, 579, 637–659; 206/315.6
See application file for complete search history.

(56) References Cited

U.S. PATENT DOCUMENTS

| | | | | |
|---|---|---|---|---|
| 5,038,984 | A | 8/1991 | Izzo | |
| 5,419,473 | A * | 5/1995 | Lamar | A63B 55/00 206/315.3 |
| 5,429,288 | A * | 7/1995 | Sattler | A45F 3/14 224/257 |
| 6,199,690 | B1 * | 3/2001 | Shin | A63B 55/00 206/315.3 |
| 6,530,129 | B1 | 3/2003 | Cheng | |

* cited by examiner

*Primary Examiner* — Adam Waggenspack
(74) *Attorney, Agent, or Firm* — Alford Law Group, Inc.; Vy H. Vu

(57) ABSTRACT

The disclosure relates to a method and apparatus for ergonomically carrying golf clubs. The method and apparatus entails dual shoulder straps to securely support a golf bag between the user's shoulder blades in an upright vertical orientation. A lifting loop provides a means for safely lifting the vertical golf bag onto the user's back with minimal arm strength by using leg and core muscles.

4 Claims, 5 Drawing Sheets

METHODS FOR A VERTICALLY CARRIED GOLF BAG

PRIORITY

This United States (U.S.) patent application is a divisional application that claims the benefit of U.S. patent application Ser. No. 14/335,459 entitled "SYSTEM AND METHOD FOR A VERTICALLY CARRIED GOLF BAG", filed Jul. 18, 2014.

FIELD

This invention is generally related to a carrying device and more specifically to a golf bag for amateur and professional use.

BACKGROUND

The game of golf is a popular sport, enjoyed internationally by a growing number of people at both the professional and recreational level. Players of all ages are learning the game for the first time and finding a rich and rewarding activity that they can enjoy for many years to come.

Golf has been played for hundreds of years with the modern game first played sometime during the fifteenth century. Golf is generally played on a grass course consisting of nine or eighteen holes. Distance between each hole may vary between one hundred yards to greater than five hundred yards.

To travel the substantial distance involved in a game of golf, many players choose to use a motorized riding cart to carry themselves and their clubs and accessories. Others players, however, may prefer to walk a course for the health benefits. As with most strenuous physical activities, injuries may occur and thus it is advantageous to use proper equipment to minimize strain.

Traditional golf bags generally include a cylindrical housing to hold the golf clubs with additional pockets for accessory items. A main strap is attached to the golf bag. The main strap is usually attached along the length of the golf bag at a high point near the top or opening of the bag and a low point near the bottom of the bag. To carry a traditional golf bag, the main strap is placed over a shoulder with the opening of the bag facing forward or off to the side. The golf bag is carried slightly canted with the opening of the bag riding higher than the bottom of the bag. The golf bag is carried behind the user and depending on orientation, forward or side facing, the bag may be resting on the user's hip or across their lower back.

A disadvantage of the traditional golf bag is weight distribution. A golf bag with golf clubs weighs approximately 15 to 25 pounds. Traditional golf bags place all of this weight on only one point on the body, the shoulder. The main strap supports the weight of the entire bag including golf clubs, and is worn only on one shoulder. Over time, carrying the weight of the golf bag and clubs may cause soft tissue injury and spinal misalignment.

With the weight of the golf bag distributed to one side of the user's hip or lower back, the normal carrying position of a golf bag is cumbersome. The weight of the bag tends to shift as the user walks with the golf bag slung over his or her shoulder. The movement of the bag may unbalance the user and slow the user down. After several hours of golfing, a normal golf bag may become quite a burden to the user.

SUMMARY OF THE INVENTION

An aspect of the invention generally relates to sport bag and more specifically to golf bag for carrying golf clubs and golf related accessories. The invention provides a carrying system designed primarily for staff bags but may be adapted for use in stand bags and smaller carry bags.

Embodiments of the invention generally comprise a cylindrical container closed at one end and open at the opposite end. The cylindrical container is adapted to hold golf clubs in an organized fashion. The cylindrical container may further comprise a plurality of pockets or pouches coupled to the main tubular body for holding golf accessories. Attached to the main body of the golf bag are a plurality of straps and handles for carrying the golf bag in a vertical fashion.

Embodiments of the invention share the novel concept of distributing the weight of a golf bag over both shoulders with the golf bag vertically positioned. Two shoulder straps are mounted at top and bottom mounting points. The two shoulder straps are mounted side by side and parallel to each other. The shoulder straps are mounted equidistant to a longitudinal axis through the center of the cylindrical main compartment of the golf bag. Each shoulder strap is worn on a separate shoulder equally distributing the weight of the golf bag on both shoulders. When properly worn, the golf bag is vertically oriented with the opening of the bag directly behind and level with the user's head. A chest strap may be used to secure the bag firmly to the user thereby reducing side to side shifting of the bag when the user is walking. A hip strap or kidney strap may also be used to secure the bag for longer distance such as from tee to green. A lifting strap mounted at the top of the bag, with the midpoint of the lifting loop directly above one of the shoulder strap's top attachment point; provide both a lifting point for ease of mounting and dismounting as well as a carry handle to move the bag over short distances.

In one embodiment of the invention, the vertically carried golf bag is designed to replace the traditional staff bag oftentimes carried by professional caddies. The staff bag type embodiment of the invention is ideally suited to the professional caddie because they spend more time on the golf course than the casual player.

DETAILED DESCRIPTION OF THE EXEMPLARY EMBODIMENTS

A method and apparatus to provide a vertically carried golf bag are described herein. In the following description, numerous specific details are set forth. However, it is understood that embodiments of the invention may be practiced without these specific details. In other instances, well-known components, structures, and techniques have not been shown in detail in order not to obscure the understanding of this description.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification do not necessarily all refer to the same embodiment.

Throughout this application the term "user" will be generically used to denote the person carrying the vertically carried golf bag. The user may also be referred to as a golfer, player, or caddie.

One recent innovation to the world of golf is the Izzo® carrying strap disclosed in U.S. Pat. No. 5,038,984 issued to Theodore-James Izzo. The Izzo system include two shoulder straps coupled to a golf bag at a midpoint and two other attachment points approximately shoulder width to either side of the midpoint. However, when carried, the Izzo carrying system is substantially horizontal along the user's lower back. The horizontal position places the heavier club heads on one side of the user's center. The unequal weight distribution may unbalance the user or will at least slow them down.

Like the Izzo system, the two strap system found in U.S. Pat. No. 6,530,129 issued to Ching-Feng Cheng also discloses a horizontally carried bag. In addition to improper weight distribution the horizontal position of the golf bag increases the user's cross section. While wearing the Izzo or Cheng carrying system a user would still have to remove their bag from the horizontal carrying position before passing through a doorway.

Figure 1:
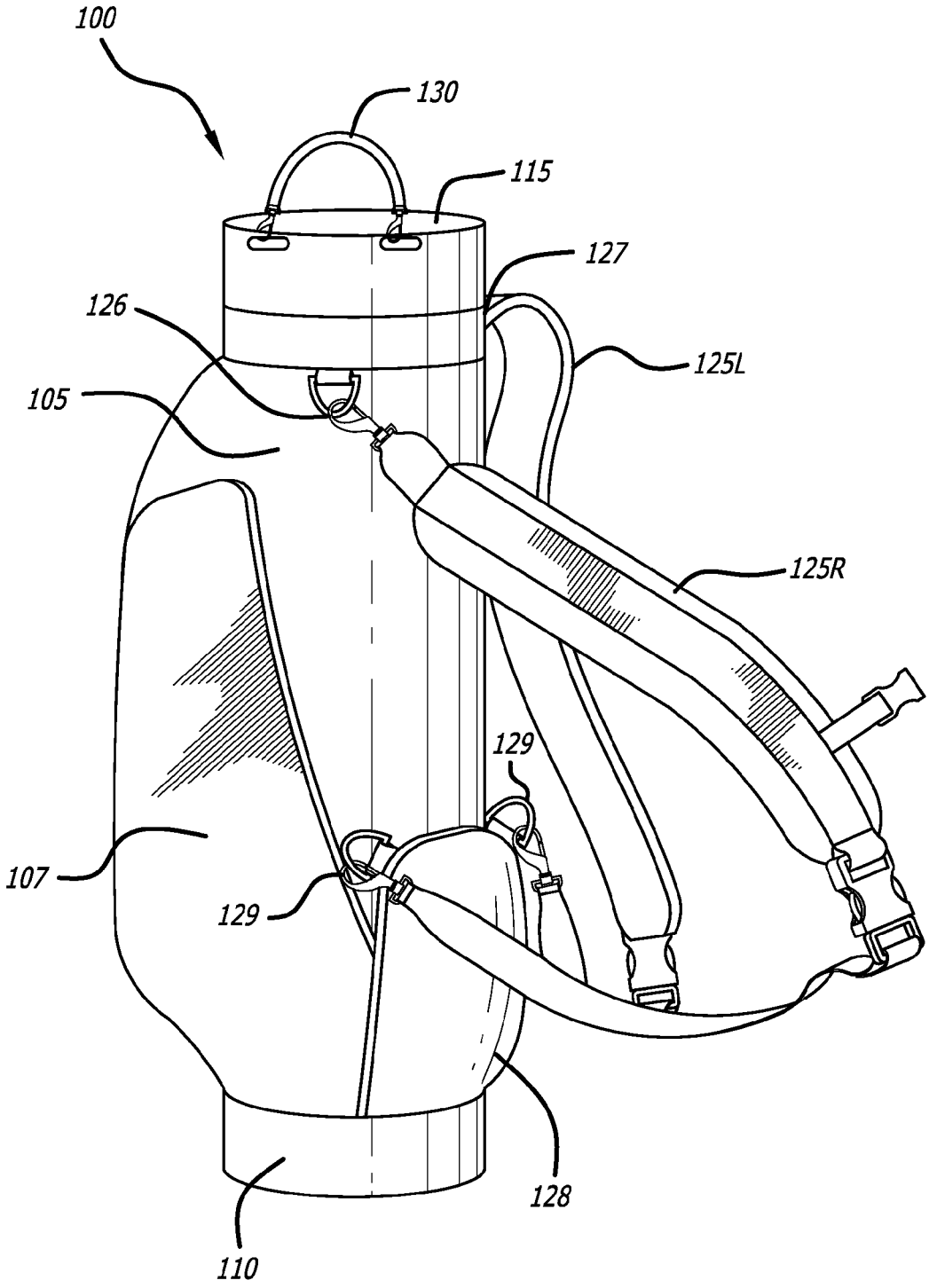
FIG. 1 illustrates a perspective view of an exemplary vertically carried golf bag in accordance with an aspect of the disclosure.

FIG. 1 illustrates a perspective view of a vertically carried golf bag 100 in accordance with an aspect of the disclosure. The vertically carried golf bag 100 may be staff bag, a stand bag, or carry bag. In FIG. 1, the vertically carried golf bag 100 is illustrated as a staff bag, however it is understood that the novel features of the invention is applicable to all types of golf bags. That being said, the functional and structural improvements of the invention over traditional golf bags may be of particular use to professional caddies that spend many hours carrying their client's golf clubs.

The vertically carried golf bag 100 comprises a substantially cylindrically shaped body 105 closed at a bottom end 110. The bottom 110 is generally rigid with a flat base adapted to allow the vertically carried bag to remain upright when the bag is resting on a flat surface. The top of the vertically carried golf bag 100 has an opening 115 for placing and removing golf clubs from the vertically carried golf bag 100. In preferred embodiments, the top of the golf bag 100 will include a lattice for holding the golf clubs in separate individual cells. A plurality of pockets 108 are arranged throughout the exterior of the golf bag 100 for storing golf accessories such gloves, tees, golf balls, towels, etc.

The cylindrical body 105 may comprise a hard plastic, metal or composite frame overlaid with foam backed flexible covering material such as leather or polyurethane. Cylindrical body 105 is suitably adapted to carry a plurality of golf clubs. In embodiments of the invention, cylindrical body 105 is partitioned into separate compartments adapted to accept individual golf club and keep them organized.

Another feature of a staff bag style embodiment of the invention is the large panels 107 along both sides of golf bag 100. In a staff bag these panels are often stenciled with the logo of the bag manufacturer. In the staff bag style embodiment of the invention illustrated by FIG. 1, panel 107 is advantageously displayed when the bag is in the carry position on the user's back. When properly carried in the upright position on the user's back, views of the panels 107 are unobstructed. This may be advantageous for professional golfers with sponsorship from the bag manufacturer.

Two shoulder straps 125R and 125L, running the longitudinal length of body 105, provide a means of carrying the golf bag 100 over long distances. Shoulder straps 125R and 125L are substantially the same length and run parallel to each other along the length of body 105. Shoulder strap 125R is attached to body 105 at a top attachment point 126 and bottom attachment point 128. Shoulder strap 125L is attached to body 105 at a top attachment point 127 and bottom attachment point 129.

In the example shown, the shoulder straps are attached to the gold bag by bolt snap hooks. The illustration is by way of example only and should not be construed as limiting the invention in any way. The shoulder straps may be attached by other removable means such as carabiners, buttons, or snaps. Alternatively the shoulder straps may be sewn directly into the golf bag outer covering.

As illustrated, top attachment points 126 and 127 are approximately 8-11 inches from the opening 115. Bottom attachment points 128 and 129 couple to the golf bag 100 approximately 6-8 inches from the bottom end 110. The location of the attachment points may vary depending on the size of the bag. The top attachment points 126 and 127 should be coupled to the golf bag 100, such that the top of the bag is approximately at the user's ear level. The importance being not to mount the attachment point so low that the user becomes top heavy or to mount the attachment points so high that the bottom 110 of the golf bag 100 interferes with the user's stride.

Shoulder straps 125R and 125L may include a cushioned portion for the comfort of the user. The cushioned portion may comprise soft flexible foam padding. Shoulder straps 125R and 125L may also include a length adjusting means such as a buckle placed between the upper and lower attachment points of the shoulder traps 125R/125L.

Coupled to the top of the golf bag 100 is a lifting loop or lifting handle 130. Lifting loop 130 provides a means for safely lifting the vertical golf bag onto the user's back, with minimal arm strength, by using leg and core muscles.

In preferred embodiments lifting loop 130 is made of a rigid but flexible plastic or rubber material. Lifting loop 130 may be attached above either strap 125L or 125R depending on the handiness of the user. For example, in FIG. 1, lifting strap 130 is attached to the top of golf bag 100 above strap 125R. The midpoint of lifting strap 130 is directly above top attachment point 126. A user lifting golf bag 100 in a right hand configuration, as depicted in FIG. 1, would use their right hand to grasp and hold lifting loop 130. While not prohibitively difficult for a left handed person, a right handed person would likely find it easier to lift golf bag 100 using the right mounted lifting loop 130 illustrated in FIG. 1.

In a preferred embodiment of the invention, lifting loop 130 may be made detachable for customization to either right or left handiness. Non-limiting examples of a detachable means of attaching lifting loop 130 to the golf bag 100 may include; buttons, snaps, hooks, straps, snap hooks, carabiners, etc. In other embodiments, two lifting loops 130 may be attached to the golf bag 100, one loop 130 above the left shoulder strap 125L and one loop above the shoulder strap 125R, to accommodate both left and right handed users.

The rigidity of the lifting loop 130 allows it to retain its semicircular loop shape. The rigidity also may help keep the lifting handle in an outward extended position approximately 90 degrees from the body of golf bag 100. By extending outward, lifting loop 130 is conveniently positioned to allow it to be grasped with one hand for short carries as well as providing a lifting handle for lifting the golf bag 100 onto the user's back.

Figure 2:
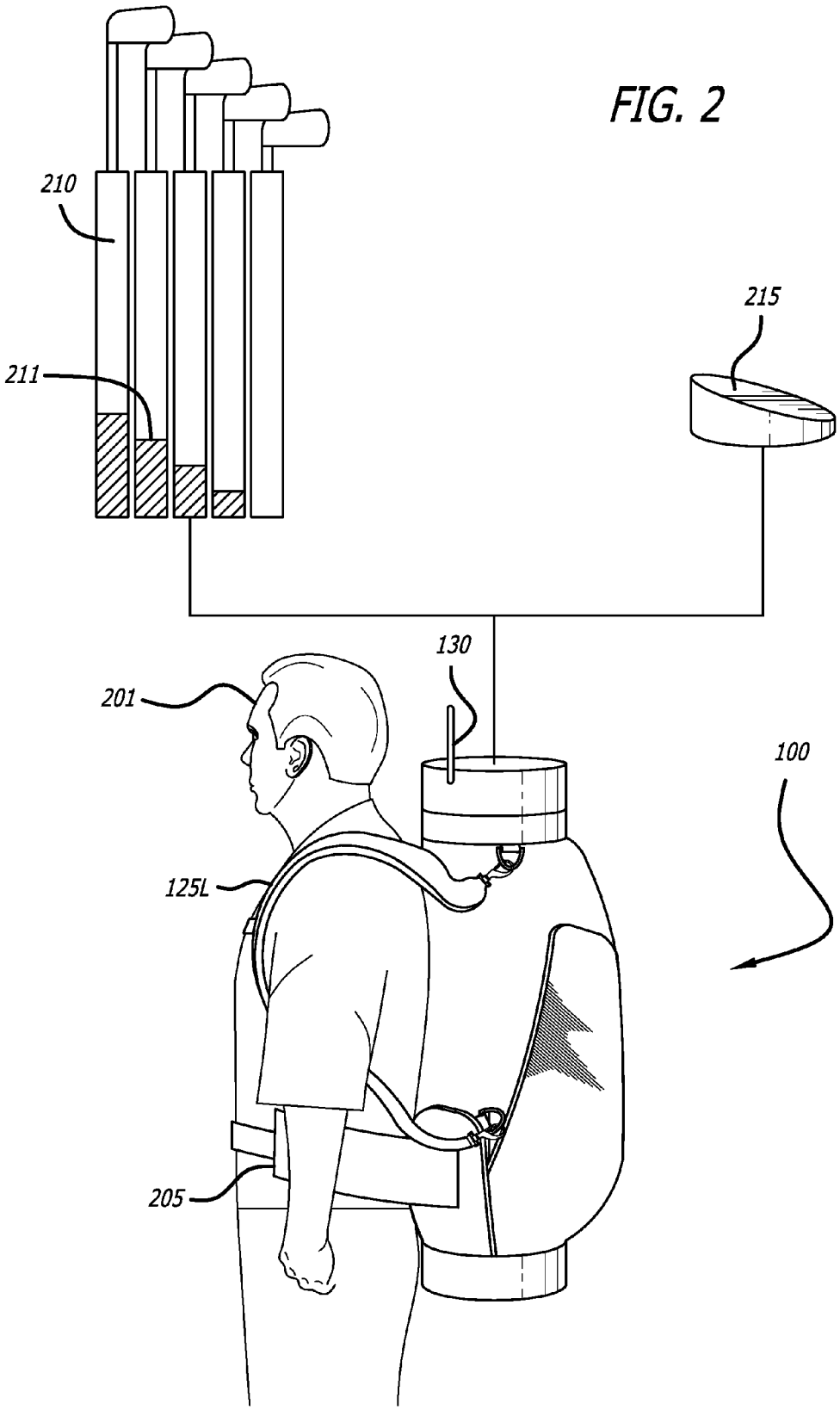
FIG. 2 illustrates a left side view of the exemplary vertically carried golf bag in accordance with another aspect of the disclosure.

FIG. 2 illustrates a left side view of an exemplary vertically carried golf bag in accordance with another aspect of the disclosure. In this illustration, a user 201 has lifted the vertically carried golf bag 100 upright onto his back and has engaged both the hip straps 205 and chest strap (shown in FIG. 6). The hip straps 205 include a padded area around the wearer's side and lower back proximal to the golf bag 100. At the distal end of the hip strap 205 may be found a quick release buckle. The quick release buckle couples the distal ends of the hip strap together and also allows for adjustment of the hip strap 205 to fit various girths. Aside from distributing some of the weight of the golf bag 100 to the user's hip, hip strap 205 also serves to stabilize the golf bag 100 when in the vertical carry position especially while the user is walking.

Figure 6:
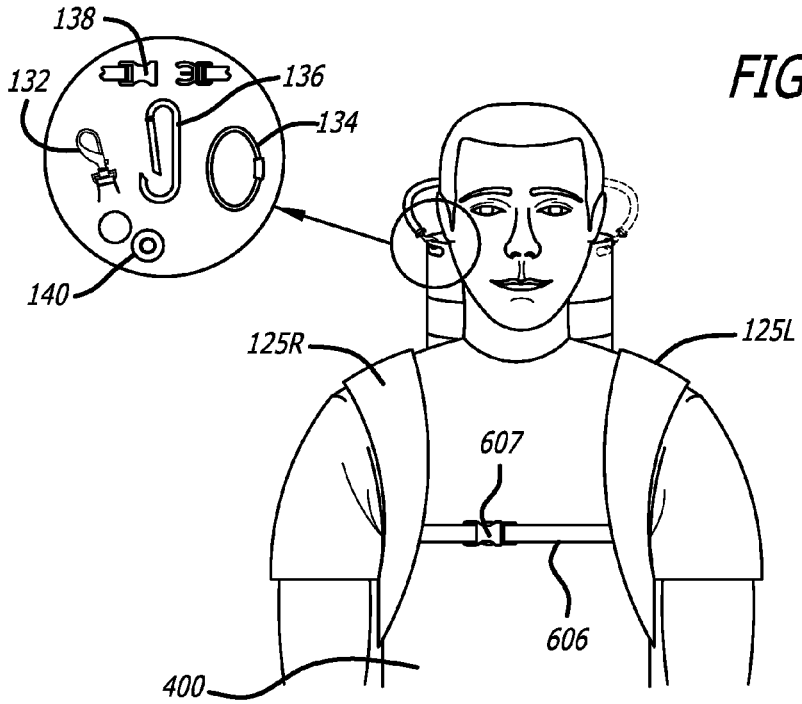
FIG. 6 illustrates a front view of the user properly wearing a vertically carried golf bag.

Briefly moving to FIG. 6, chest strap 606 is illustrated in the engaged position. Chest strap 606 comprises two separate sections. Each section is attached at one end to a shoulder strap. The opposite unattached ends of the two sections of chest strap 606 are coupled to complementary parts of a quick release buckle 607. In the embodiment illustrated in FIG. 6, chest strap 606 is illustrated coupled together at the quick release buckle 607. Like hip strap 205, chest strap 606 stabilizes the golf bag 100 when in the upright carry position.

Going back to FIG. 2, another novel feature of the vertically carried golf bag is illustrated with reference to reference numbers 210 and 215. Embodiments of the invention may include an organizational feature that raises the golf clubs above the head of the user. In one embodiment of the invention, the organizational feature may include tubes 210 to raise the height of the forward golf clubs. The tubes may be partially obstructed at 211 such that the leading tubes, i.e. those closest to the user while the golf bag 100 is vertically carried, will be obstructed higher up the tube length. Tubes further away from the user will be obstructed further down the tube length. Golf clubs placed in the tubes closer to the user, will rise higher as the end of the golf club rests on the obstruction. In the preferred embodiment, the golf clubs are in descending height from front (nearest the user) to back.

Another method of raising the height of the clubs nearest the user, may involve insertion of a slanted filler material 215. The slanted filler material 215 may be formed of some light material that resists deformation, such as hard foam or plastic. The slanted filler material 215 is preferably slanted from front (nearest the user) to back raising the nearer golf clubs higher nearest the user. Raising the nearest clubs above the head of the user may prevent the clubs from contacting the back of the user's head, especially while walking.

Figure 3:
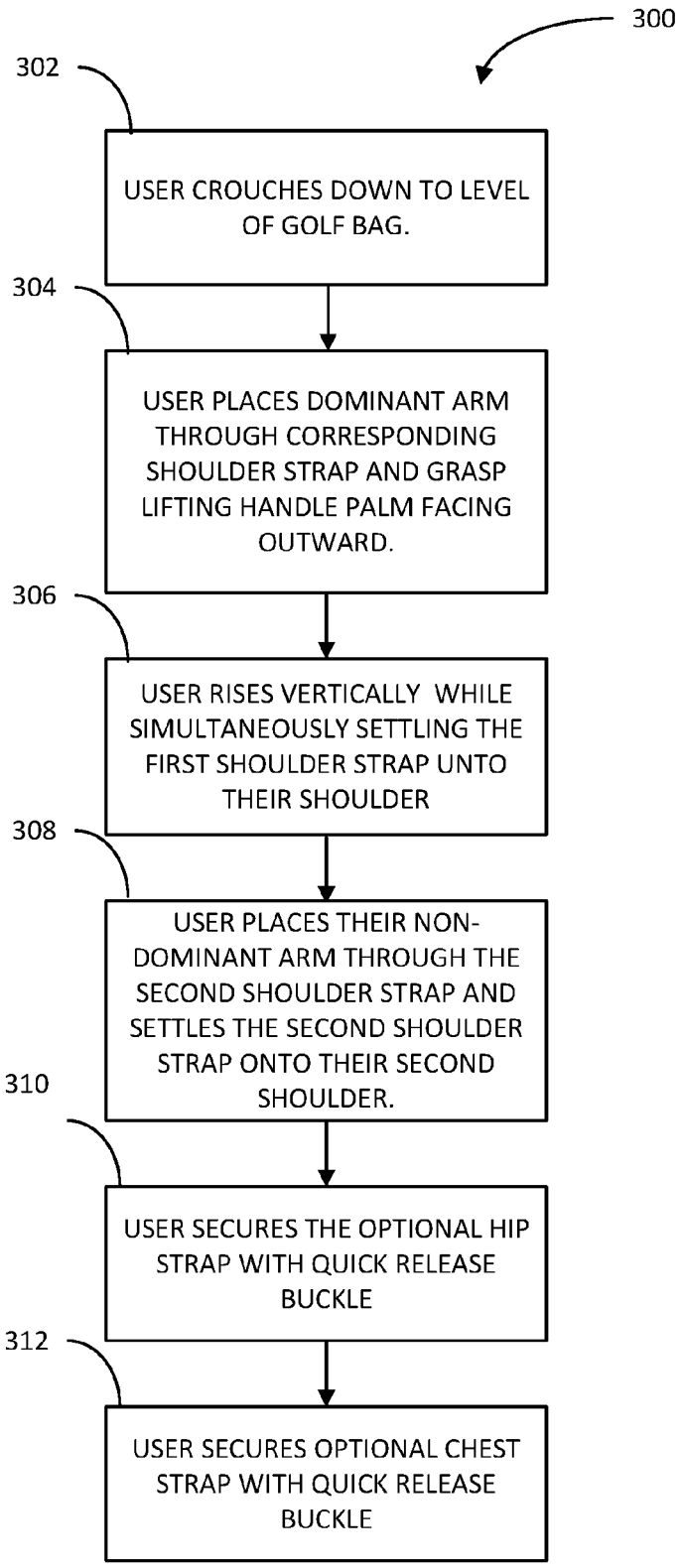
FIG. 3 is a flow chart of a method of lifting a vertically carried golf bag from a squat using the lift handle.

FIG. 3 is a block diagram of an exemplary method 300 of lifting the vertically carried golf bag. To properly lift the vertically carried golf bag, in box 302, the user crouches or squats down to the height of the golf bag 100. In box 304, the user then places his/her dominant arm through the corresponding first shoulder strap, e.g. right arm through right shoulder strap, and firmly grasps the lifting loop 130 palm facing outward. Preferably using mainly leg strength, in box 306, the user rises vertically out of the squatting position while simultaneously settling the first shoulder strap unto their right shoulder. In box 308, the user slightly reaches back with the opposite arm, and places their other (non-dominant) arm through the second shoulder strap and settles the second shoulder strap onto their second shoulder. Once both shoulder straps 125R/125L are comfortably seated, in box 310, the user may secure the optional hip strap by engaging the complementary sections of the quick release buckle. The chest strap may be secured in box 312 in a similar manner for even greater stabilization of the vertically carried golf bag 100.

Figure 4:
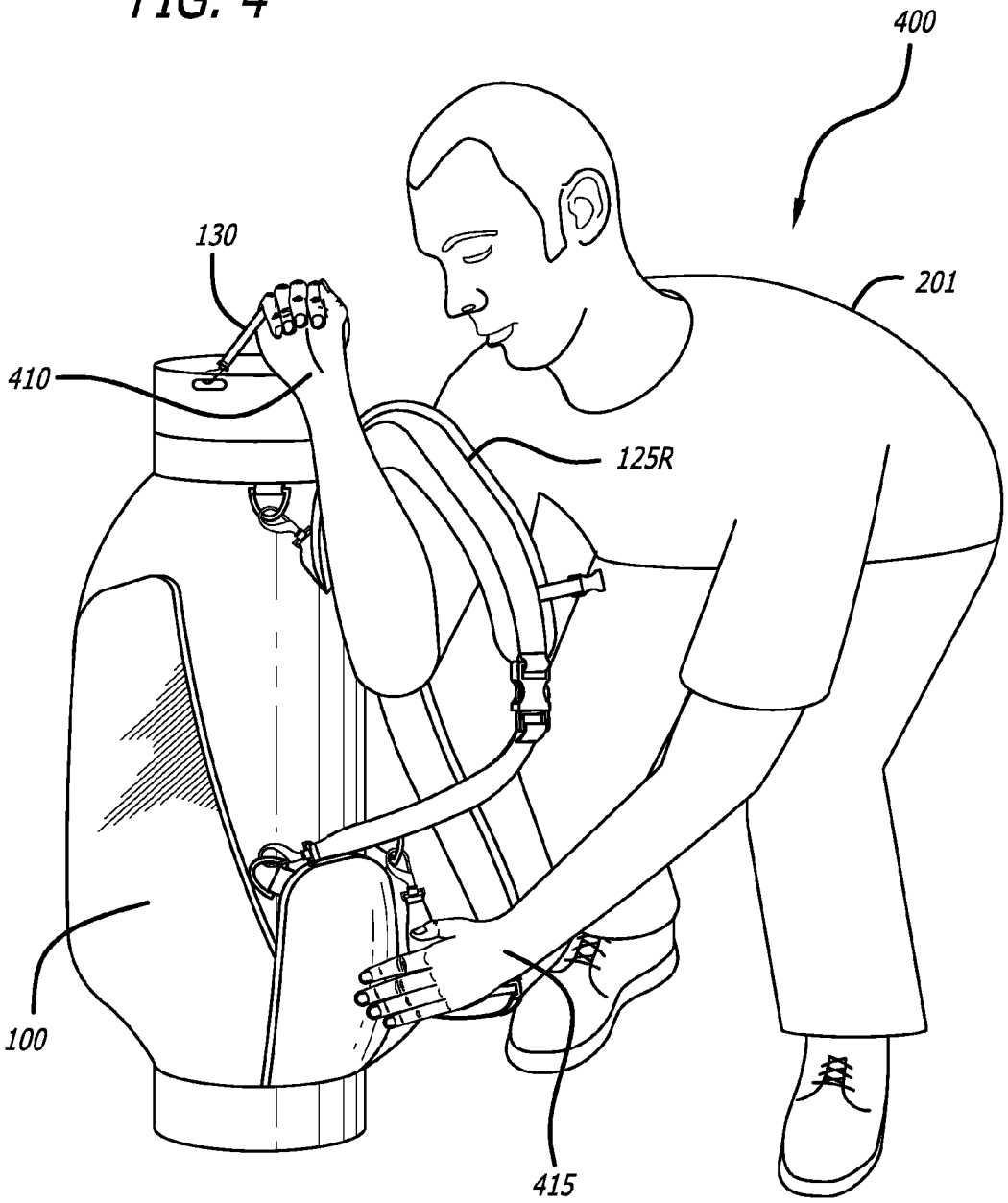
FIG. 4 illustrates a user in a squatting position preparatory to lifting the vertically carried golf bag.

FIG. 4 illustrates an exemplary user preparing to lift the vertically carried golf bag. In this illustration, the user 405 crouches down and places his dominant arm 410 (in this case his right arm) through the right shoulder strap 125R. Using the same arm, the user 400 then grasps the lifting loop 130 with his palm facing outward. The user's other arm 415 may be placed at the bottom quarter of the golf bag 100 to stabilize the golf bag as it transitions onto the user's back. As depicted in FIG. 4, the user's arm grasping lifting loop 130 forms a 90 degree bend at the elbow with the grasping forearm substantially vertical. As the user raises from a crouch the arm holding the lifting loop 130 maintains the same position. Instead of using arm strength the lifting loop 130 allows the user to safely lift the vertical golf bag 100 onto the user's back using mainly leg and core muscles.

Figure 5:
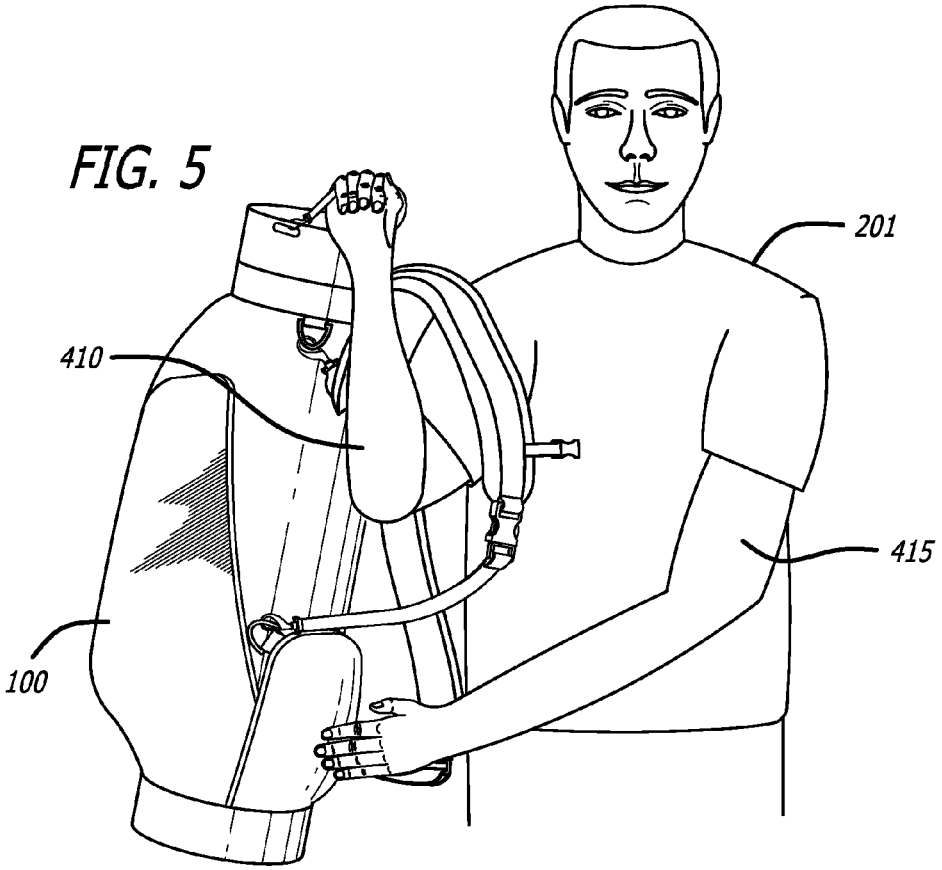
FIG. 5 illustrates a user in an upright position after lifting the vertically carried golf bag.

FIG. 5 illustrates the user 400 with the golf bag 100 partially lifted into the vertically carried position. In this illustration, the user 400 has stood up from his crouched position. The user's dominant arm 410 is still threaded through the right shoulder strap 125R and he is still grasping lifting loop 130. The user's non-dominant arm is stabilizing the golf bag. Once the position in FIG. 5 has been achieved, the user would next reach back with his non-dominant arm 415 and thread it through the left shoulder strap 125L. By bringing left shoulder strap 125L forward with the non-dominant arm 415, the user positions the golf bag 100 squarely on his or her back. With both shoulder straps 125R/125L in place on the user's shoulders, the golf bag 100 is in a vertically carried position.

FIG. 6 illustrates the golf bag 100 in the vertically carried position. Both shoulder straps 125L and 125R are properly positioned on the user's shoulders. Buckles on the shoulder strap may be used to adjust the length of the shoulder straps to accommodate the ergonomics of each user's body dimensions. In a properly carried vertical position, the longitudinal axis of the golf bag is aligned along the user's spine with the top of the bag directly behind the user's head approximately at ear level. The golf clubs nearest the user are raised above the user's head and prevented from hitting the user with each stride.

Although the detailed description have disclosed embodiments of a vertically carried golf bag with similarities to a staff bag, it should be noted that the novel features of the invention are equally applicable to other types of golf bag. For example, a stand bag may be adapted with the dual shoulder strap and lifting strap system of the invention. Due to the lighter weight material comprising a stand bag, the attachment points for the shoulder straps would preferably have an adequate amount of reinforcing to withstand normal use. A person of normal skill in the relevant art would be able to adapt the novel features of the invention to stand bags and smaller carry bags with minimal amount of experimentation.

The foregoing discussion merely describes some exemplary embodiments of the present invention. One skilled in the art will readily recognize from such discussion, the accompanying drawings and the claims that various modifications can be made without departing from the spirit and scope of the invention.

What is claimed is:

1. A method for vertically carrying golf clubs comprising: crouching down level with the golf bag, then placing an arm through a right shoulder strap, and then grasping a lifting loop with the hand at the end of the arm in the right shoulder strap with the palm facing outward, and then lifting the vertically carried golf bag with the lifting loop attached to an upper portion of the golf bag, the lifting loop formed of a semi-rigid plastic or rubber material;

supporting the vertically carried golf bag in a vertical orientation with a left shoulder strap attached at one end to the upper portion of the golf bag and attached at the opposite end to a lower portion of the golf bag and a right shoulder strap attached at one end to the upper portion of the golf bag and attached at the opposite end to the lower portion of the golf bag; and traversing a golf course while carrying the golf bag with a longitudinal axis of a cylindrical main compartment of the vertically carried golf bag vertically aligned with a user's spine and with the top of the cylindrical main compartment directly behind the user's head;

wherein the midpoint of the lifting loop is directly above either the upper end of the right shoulder strap or the upper end of the left shoulder strap.

2. The method of claim 1, further comprising, before traversing the golf course;

securing the vertically carried golf bag with a hip strap attached the lower portion of the golf bag; and securing the vertically carried golf bag with a chest strap attached to the left and right shoulder straps.

3. A method for lifting and using a vertically carried golf bag comprising:

crouching down level with a vertically carried golf bag, then placing a dominant arm through a first shoulder strap of the vertically carried golf bag, then grasping a lifting loop with a hand of the dominant arm, with the palm of the hand facing away from the vertically carried gold bag and an elbow of the dominant arm held substantially at a ninety degree angle, the lifting loop attached to an upper portion of the golf bag and formed of a semi-rigid plastic or rubber material, and then lifting the vertically carried golf bag substantially vertical while settling the first shoulder strap onto a shoulder of the dominant arm;

placing a non-dominant arm through a second shoulder strap of the vertically carried golf bag and settling the second shoulder strap onto a shoulder of the non-dominant arm;

supporting the vertically carried golf bag in a vertical orientation with a first shoulder strap attached at one end to the upper portion of the golf bag and attached at the opposite end to a lower portion of the golf bag and a second shoulder strap attached at one end to the upper portion of the golf bag and attached at the opposite end to the lower portion of the golf bag; and traversing a golf course while carrying the golf bag with a longitudinal axis of a cylindrical main compartment of the vertically carried golf bag vertically aligned with a user's spine and with the top of the cylindrical main compartment directly behind the user's head;

wherein the midpoint of the lifting loop is directly above either the upper end of the right shoulder strap or the upper end of the left shoulder strap.

4. The method of claim 3, further comprising, before traversing the golf course;

securing the vertically carried golf bag with a hip strap attached the lower portion of the golf bag; and securing the vertically carried golf bag with a chest strap attached to the left and right shoulder straps.

* * * * *